US009574158B2

(12) United States Patent
Lagona et al.

(10) Patent No.: US 9,574,158 B2
(45) Date of Patent: Feb. 21, 2017

(54) LUBRICATING OIL COMPOSITION AND ADDITIVE THEREFOR HAVING IMPROVED WEAR PROPERTIES

(71) Applicant: AFTON CHEMICAL CORPORATION, Richmond, VA (US)

(72) Inventors: Jason A. Lagona, Richmond, VA (US); John T. Loper, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 14/701,899

(22) Filed: May 1, 2015

(65) Prior Publication Data

US 2015/0344808 A1 Dec. 3, 2015

Related U.S. Application Data

(60) Provisional application No. 62/005,135, filed on May 30, 2014.

(51) Int. Cl.
*C10M 161/00* (2006.01)
*C10M 141/10* (2006.01)

(52) U.S. Cl.
CPC ..... *C10M 161/00* (2013.01); *C10M 141/10* (2013.01); *C10M 2215/08* (2013.01); *C10M 2215/28* (2013.01); *C10M 2223/045* (2013.01); *C10N 2210/02* (2013.01); *C10N 2220/021* (2013.01); *C10N 2240/102* (2013.01)

(58) Field of Classification Search
CPC ..... C10M 161/00
See application file for complete search history.

(56) References Cited

U.S. PATENT DOCUMENTS

| | | | | |
|---|---|---|---|---|
| 3,663,561 | A | 5/1972 | Blaha | |
| 4,234,435 | A * | 11/1980 | Meinhardt | C10L 1/198 508/192 |
| 4,636,322 | A | 1/1987 | Nalesnik | |
| 4,863,623 | A | 9/1989 | Nalesnik | |
| 5,057,583 | A | 10/1991 | Tung et al. | |
| 6,114,288 | A | 9/2000 | Fujitsu et al. | |
| 6,300,291 | B1 | 10/2001 | Hartley et al. | |
| 6,548,458 | B2 | 4/2003 | Loper | |
| 6,569,821 | B1 | 5/2003 | Ibrahim et al. | |
| 6,723,685 | B2 | 4/2004 | Hartley et al. | |
| 6,759,375 | B2 * | 7/2004 | Curtis | C10M 169/04 508/551 |
| 7,214,649 | B2 | 5/2007 | Loper et al. | |
| 7,598,211 | B2 | 10/2009 | Karol et al. | |
| 7,645,726 | B2 | 1/2010 | Loper | |
| 7,732,390 | B2 | 6/2010 | Kakkhodayan et al. | |
| 8,048,831 | B2 | 11/2011 | Loper | |
| 8,455,568 | B2 | 6/2013 | Ruhe, Jr. | |
| 8,703,680 | B2 | 4/2014 | Suen | |
| 8,703,682 | B2 | 4/2014 | Hartley et al. | |
| 8,759,262 | B2 | 6/2014 | Irving et al. | |
| 2004/0176260 | A1 | 9/2004 | Shirahama et al. | |
| 2006/0063685 | A1 | 3/2006 | Purmer et al. | |
| 2009/0186784 | A1 | 7/2009 | Diggs et al. | |
| 2012/0101017 | A1 | 4/2012 | Duggal | |
| 2013/0005622 | A1 * | 1/2013 | Lyon | C10M 171/02 508/192 |
| 2013/0040866 | A1 * | 2/2013 | Mathur | C10M 159/12 508/306 |
| 2013/0225461 | A1 | 8/2013 | Barton et al. | |
| 2013/0252865 | A1 | 9/2013 | Hartley et al. | |
| 2014/0024569 | A1 | 1/2014 | Bera et al. | |
| 2014/0179579 | A1 | 6/2014 | Styer et al. | |
| 2014/0187458 | A1 | 7/2014 | Galic et al. | |

FOREIGN PATENT DOCUMENTS

| | | |
|---|---|---|
| EP | 0768366 A1 | 4/1997 |
| GB | 2288815 A1 | 11/1995 |

* cited by examiner

*Primary Examiner* — Taiwo Oladapo
(74) *Attorney, Agent, or Firm* — Luedeka Neely Group, P.C.

(57) ABSTRACT

A compression-ignited engine lubricant and a method for reducing engine wear. The lubricant including, (a) a base oil; (b) oleamide; (c) zinc dihydrocarbyl dithiophosphate; and (d) a functionalized dispersant. The functionalized dispersant is made by reacting together (i) a hydrocarbyl-dicarboxylic acid or anhydride, (ii) a polyamine, (iii) a dicarboxyl-containing fused aromatic compound or anhydride thereof, and optionally, (iv) a non-aromatic dicarboxylic acid or anhydride, wherein the hydrocarbyl group of the hydrocarbyl-dicarboxylic acid or anhydride has a number average molecular weight of greater than 1800 Daltons as determined by gel permeation chromatography.

19 Claims, No Drawings

LUBRICATING OIL COMPOSITION AND ADDITIVE THEREFOR HAVING IMPROVED WEAR PROPERTIES

RELATED APPLICATION

This application claims priority to provisional application Ser. No. 62/05,135, filed May 30, 2014.

TECHNICAL FIELD

The disclosure relates to lubricating oil compositions. More specifically, the present invention is directed to crankcase lubricants for compression-ignited (diesel) engines, especially heavy duty diesel engines. These lubricating compositions provide improved for improving the wear properties of the lubricant composition.

BACKGROUND AND SUMMARY

A lubricating oil composition for compressed-ignited engines for land-based vehicles often has to meet certain performance requirements as stipulated in specifications established by the industry and/or original equipment manufacturers (OEMs). In general, heavy duty engine oils have to provide adequate levels of oxidation and wear protection, sludge and deposit formation control, fuel economy benefits, compatibility with sealing materials, and other desirable physical and rheological characteristics that are essential for lubrication and serviceability, as determined by various standardized engine and bench tests. For example, a high frequency reciprocating rig wear test (HFRR) is used to determine the wear protection properties of a lubricant composition. Typically, wear protection can be provided by the addition of phosphorus to the fluid. However, environmental regulations and OEM specifications may restrict the maximum phosphorus levels in the lubricant. Hence, providing sufficient or improved wear performance without increasing the phosphorus concentration in the lubricant is desirable.

With regard to the foregoing, embodiments of the disclosure provide a compression-ignited engine lubricant composition and a method for reducing engine wear. The heavy duty engine lubricant composition includes (a) a base oil;
(b) from about 0.04 to about 0.2 wt. % of oleamide based on a total weight of the lubricant composition;
(c) zinc dihydrocarbyl dithiophosphate; and
(d) a hydrocarbyl soluble dispersant.

In a further embodiment, the hydrocarbyl soluble dispersant is a functionalized dispersant comprising a reaction product of (i) a hydrocarbyl-dicarboxylic acid or anhydride, (ii) a polyamine, (iii) a dicarboxyl-containing fused aromatic compound or anhydride thereof, and optionally, (iv) a non-aromatic dicarboxylic acid or anhydride, wherein the hydrocarbyl group of the hydrocarbyl-dicarboxylic acid or anhydride has a number average molecular weight of greater than 1800 Daltons as determined by gel permeation chromatography.

In a further embodiment, the functionalized dispersant comprises a reaction product of (i) a hydrocarbyl-dicarboxylic acid or anhydride, (ii) a polyamine, (iii) 1,8-naphtahlic anhydride, and optionally, (iv) a non-aromatic dicarboxylic acid or anhydride.

In a further embodiment, the functionalized dispersant comprises a reaction product of (i) a hydrocarbyl-dicarboxylic acid or anhydride, (ii) a polyamine, (iii) 1,8-naphtahlic anhydride, and optionally, (iv) a non-aromatic dicarboxylic acid or anhydride.

In another embodiment, the functionalized dispersant comprises a reaction product of (i) a polyisobutenyl succinic acid or anhydride, component, (ii) a polyamine, (iii) 1,8-naphthalic anhydride, and (iv) comprises maleic anhydride.

In another embodiment, the polyisobutenyl group of component (d) is derived from polyisobutylene having greater than 50 mole percent terminal vinylidene content.

The another embodiment, from about 0.25 to about 1.5 moles of component (iv) are reacted per mole of component (ii).

In a further embodiment, the lubricant composition further comprises (e) one or more hydrocarbyl substituted succinimide dispersants other than component (d), wherein the hydrocarbyl substituent of component (e) is derived from a polyolefin having a number average molecular weight ranging from about 950 to about 3000 Daltons as determined by gel permeation chromatography and wherein a weight ratio of (e) to (d) in the lubricant ranges from about 1:1 to about 1:10.

In another embodiment of the disclosure, zinc dihydrocarbyl dithiophosphate is derived from all primary alcohols; all secondary alcohols; a mixture of primary and secondary alcohols, or a mixture of zinc dihydrocarby dithiophosphates derived from primary and secondary alcohols, wherein the mole percent of primary alcohols in the mixture of alcohols or the mole percent hydrocarbyl groups in the mixture of zinc dithydrocarbyl dithiophosphates is at least 30 mole %.

In another embodiment of the disclosure, the zinc dihydrocarbyl dithiophosphate is derived from all primary alcohols or a mixture of primary and secondary alcohols.

In another embodiment, at least 60 mole % of hydrocarbyl groups in the zinc dihydrocarbyl dithiophosphate are derived from primary alcohols.

In a further embodiment, the lubricant comprises a mixture of zinc dihydrocarbyl dithiophosphates and wherein at least 30 mole % of hydrocarbyl groups in the mixture of zinc dihydrocarbyl dithiophosphates are derived from primary alcohols.

In a further embodiment, the lubricant contains from about 200 to about 1500 ppm by weight of phosphorus based on a total weight of the lubricant.

In a further embodiment, the zinc dithiophosphate delivers approximately 1100 ppm of phosphorus to the lubricant based on a total weight of the lubricant.

In another embodiment, the lubricant comprises from about 0.04 to about 0.2 wt. % of oleamide based on a total weight of the lubricant composition.

In one embodiment of the disclosure the lubricant comprises from about 1 to about 10 percent by weight of the dispersant based on a total weight of the lubricant composition.

In one embodiment of the disclosure the lubricant comprises from about 2 to about 7 percent by weight of the dispersant based on a total weight of the lubricant composition.

Another embodiment of the disclosure provides a method for reducing wear in a compression-ignited engine. The method includes lubricating the engine with a lubricant composition comprising:

(a) a base oil;
(b) oleamide;
(c) a zinc dithydrocarbyl dithiophosphate; and
(d) a functionalized dispersant comprising a reaction product of (i) a hydrocarbyl-dicarboxylic acid or anhydride, (ii) a polyamine, (iii) a dicarboxyl-containing fused aromatic compound or anhydride thereof, and optionally, (iv) a non-aromatic dicarboxylic acid or anhydride, wherein the hydrocarbyl group of the hydrocarbyl-dicarboxylic acid or anhydride has a number average molecular weight of greater than 1800 Daltons as determined by gel permeation chromatography.

A further embodiment of the disclosure provides a method for reducing wear in a compression-ignited engine. The method includes (1) lubricating the engine with a lubricant containing (a) a base oil; (b) from about 0.04 to about 0.2 wt. % oleamide based on a total weight of the lubricant; (c) zinc dihydrocarbyl dithiophosphate in an amount sufficient to provide from about 200 to about 1100 ppm by weight of phosphorus based on a total weight of the lubricant; and (d) from about 2 to about 7 wt % of a hydrocarbyl soluble dispersant based on a total weight of the lubricant.

In another embodiment of the disclosure, the zinc dihydrocarbyl dithiophosphate is derived from all primary alcohols or a mixture of primary and secondary alcohols.

In another embodiment, at least 60 mole % of hydrocarbyl groups in the zinc dihydrocarbyl dithiophosphate are derived from primary alcohols In another embodiment, the lubricant comprises from about 0.04 to about 0.2 wt. % of oleamide based on a total weight of the lubricant composition.

In one embodiment of the disclosure the lubricant comprises from about 1 to about 10 percent by weight of the dispersant based on a total weight of the lubricant composition.

In one embodiment of the disclosure the lubricant comprises from about 2 to about 7 percent by weight of the dispersant based on a total weight of the lubricant composition.

In another embodiment, a method of reducing wear in a compression-ignition engine comprises lubricating the engine with a lubricant comprising: (a) a base oil; (b) from about 0.04 to about 0.2 wt. % oleamide based on a total weight of the lubricant; (c) zinc dihydrocarbyl dithiophosphate in an amount sufficient to provide from about 200 to about 1100 ppm by weight of phosphorus based on a total weight of the lubricant; and (d) from about 2 to about 7 wt % of a hydrocarbyl soluble dispersant based on a total weight of the lubricant.

The following definitions of terms are provided in order to clarify the meanings of certain terms as used herein.

As used herein, the terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating composition excluding the major amount of base oil stock mixture. The additive package may or may not include the viscosity index improver or pour point depressant.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic moiety);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Additional details and advantages of the disclosure will be set forth in part in the description which follows, and/or may be learned by practice of the disclosure. The details and advantages of the disclosure may be realized and attained by means of the elements and combinations particularly pointed out in the appended claims.

DETAILED DESCRIPTION

The present disclosure will now be described in the more limited aspects of embodiments thereof, including various examples of the formulation and use of the present disclosure. It will be understood that these embodiments are presented solely for the purpose of illustrating the invention and shall not be considered as a limitation upon the scope thereof.

Lubricants, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines, aviation piston engines, low-load diesel engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubricated coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The lubricant composition for an internal combustion engine may be suitable for any engine lubricant irrespective of the sulfur, phosphorus, or sulfated ash (ASTM D-874) content. The sulfur content of the engine oil lubricant may be about 1 wt. % or less, or about 0.8 wt. % or less, or about 0.5 wt. % or less, or about 0.3 wt. % or less. In one embodiment the sulfur content may be in the range of about 0.00 wt. % to about 0.5 wt. %, or about 0.01 wt. % to about 0.3 wt. %. The phosphorus content may be about 0.2 wt. % or less, or about 0.1 wt. % or less, or about 0.085 wt. % or less, or about 0.08 wt. % or less, or even about 0.06 wt. % or less, about 0.055 wt. % or less, or about 0.05 wt. % or less. In one embodiment the phosphorus content may be about 50 ppm to about 1200 ppm, or about 325 ppm to about 850 ppm. The total sulfated ash content may be about 2 wt. % or less, or about 1.5 wt. % or less, or about 1.1 wt. % or less, or about 1 wt. % or less, or about 0.8 wt. % or less, or about 0.5 wt. % or less. In one embodiment the sulfated ash content may be about 0.05 wt. % to about 0.9 wt. %, or about 0.1 wt. % or about 0.2 wt. % to about 0.45 wt. %. In another embodiment, the sulfur content may be about 0.4 wt. % or less, the phosphorus content may be about 0.08 wt. % or less, and the sulfated ash is about 1 wt. % or less. In yet another embodiment the sulfur content may be about 0.3 wt. % or less, the phosphorus content is about 0.05 wt. % or less, and the sulfated ash may be about 0.8 wt. % or less.

In one embodiment the lubricating composition is an engine oil, wherein the lubricating composition may have (i) a sulfur content of about 0.5 wt. % or less, (ii) a phosphorus content of about 0.15 wt. % or less, and (iii) a sulfated ash content of about 1.5 wt. % or less.

In one embodiment the lubricating composition is suitable for a 2-stroke or a 4-stroke marine diesel internal combustion engine. In one embodiment the marine diesel combustion engine is a 2-stroke engine. In some embodiments, the lubricating composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating composition is suitable for use with engines powered by low sulfur fuels, such as fuels containing about 1 to about 5% sulfur. Highway vehicle fuels contain about 15 ppm sulfur (or about 0.0015% sulfur).

Low speed diesel typically refers to marine engines, medium speed diesel typically refers to locomotives, and high speed diesel typically refers to highway vehicles. The lubricating composition may be suitable for only one of these types or all.

Further, lubricants of the present description may be suitable to meet one or more industry specification requirements such as ILSAC GF-3, GF-4, GF-5, GF-6, PC-11, CI-4, CJ-4, ACEA A1/B1, A2/B2, A3/B3, A5/B5, C1, C2, C3, C4, E4/E6/E7/E9, Euro 5/6, Jaso DL-1, Low SAPS, Mid SAPS, or original equipment manufacturer specifications such as Dexos™ 1, Dexos™ 2, MB-Approval 229.51/229.31, VW 502.00, 503.00/503.01, 504.00, 505.00, 506.00/506.01, 507.00, BMW Longlife-04, Porsche C30, Peugeot Citroen Automobiles B71 2290, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, or lubricating, are designed to meet specific and stringent manufacturer requirements.

The present disclosure provides novel lubricating oil blends specifically formulated for use as crankcase lubricants. In particular, the lubricant compositions described herein are primarily suitable for heavy duty diesel engines that are used in land-based vehicles.

Embodiments of the present disclosure may provide lubricating oils suitable for crankcase applications and having improvements in the following characteristics: air entrainment, alcohol fuel compatibility, antioxidancy, antiwear performance, biofuel compatibility, foam reducing properties, friction reduction, fuel economy, pre-ignition prevention, rust inhibition, sludge and/or soot dispersability, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil. The fully formulated engine oil may exhibit improved performance properties, based on the additives added and their respective proportions.

(a) Base Oil

The base oil used in the lubricating oil compositions herein may be selected from any of the base oils in Groups I-V as specified in the American Petroleum Institute (API) Base Oil Interchangeability Guidelines. The five base oil groups are as follows:

TABLE 1

| Base Oil Group[1] | Sulfur (wt. %) | | Saturates (wt. %) | Viscosity Index |
|---|---|---|---|---|
| Group I | >0.03 | And/or | <90 | 80 to 120 |
| Group II | ≤0.03 | And | ≥90 | 80 to 120 |
| Group III | ≤0.03 | And | ≥90 | ≥120 |
| Group IV | all polyalphaolefins (PAOs) | | | |
| Group V | all others not included in Groups I-IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricant compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the oil of lubricating viscosity present may be the balance remaining after subtracting from 100 wt. % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

A particularly desirable base oil for use with the additive components of the disclosure is a Group II base oil as defined above. The base oil may be combined with an additive composition as disclosed in embodiments herein to provide an engine lubricant composition. Accordingly, the base oil may be present in the engine lubricant composition in an amount ranging from about 50 wt. % to about 95 wt. % based on a total weight of the lubricant composition. For example, the base oil that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

(b) Friction Modifiers

Embodiments of the present disclosure may include one or more friction modifiers. Suitable friction modifiers may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, glycerol esters, boric acid esters, thiadiazoles, and the like.

Suitable friction modifiers may contain hydrocarbyl groups that are selected from straight chain, branched chain, or aromatic hydrocarbyl groups or admixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms and may be saturated or unsaturated.

Aminic friction modifiers may include amides of polyamines. Such compounds can have hydrocarbyl groups that are linear, either saturated or unsaturated, or a mixture thereof and may contain from about 12 to about 25 carbon atoms.

Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference.

Other friction modifiers may include an organic, ashless (metal-free), nitrogen-free organic friction modifier. Such friction modifiers may include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Another example of an organic ashless nitrogen-free friction modifier is known generally as glycerol monooleate (GMO) which may contain mono- and diesters of oleic acid. Other suitable friction modifiers are described in U.S. Pat. No. 6,723,685, herein incorporated by reference. Another suitable friction modifier may include a mixture of glycine derivatives made according to Blend 18 in U.S. Patent Publication No. 2014/0179579, incorporated herein by reference. The ashless friction modifier may be present in the lubricant composition in an amount ranging from about 0.1 to about 0.4 percent by weight based on a total weight of the lubricant composition. One or more friction modifiers may be used.

Another suitable friction modifier is a fatty acid amide which is the reaction product of a fatty acid and an alkanol amine. Fatty acid amides are of the general formula

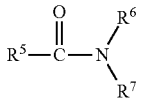

in which $R^5$ may be a saturated or unsaturated alkyl chain derived from a fatty acid. The fatty acid amides can be divided into three categories. The first is primary monoamides in which $R^5$ is a fatty alkyl or alkenyl chain of $C_5$-$C_{23}$ and $R^6$ and $R^7$ are hydrogen. The second, and by far the largest category, is substituted monoamides, including secondary, tertiary, and alkanolamides in which $R^5$ is a fatty alkyl or alkenyl chain of $C_5$-$C_{23}$; $R^6$ and $R^7$ may be hydrogen, fatty alkyl, aryl, or alkylene oxide condensation groups with at least one alkyl, aryl, or alkylene oxide group. The third category is bis(amides) of the general formula:

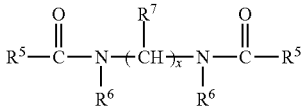

where $R^5$ groups are fatty alkyl or alkenyl chains. $R^6$ and $R^7$ may be hydrogen, fatty alkyl, aryl, or alkylene oxide condensation groups. Other amides include halogenated amides and multifunctional amides such as amidoamines and polyamides. Examples of fatty acid amides and may include, but are not limited to, lauramide, myristamide, palmitamide, stearamide, palmitoleamide, oleamide, linoleamide, and the like. The amount of fatty acid amide friction modifier may range from about 0.01 to about 1.0 wt. % based on a total weight of the lubricant composition. For example the example, the fatty acid amide friction modifier may range from about 0.02 wt. % to about 0.8 wt. %, such as from about 0.04 wt. % to about 0.5 wt. % based on a total weight of the lubricant composition.

Compositions described herein may contain a boron-containing friction modifier that is derived from diethanolamine, a fatty oil, and boric acid. The boron-containing friction modifier agent may be sole friction modifier or the boron-containing friction modifier be combined with one or more metal free friction modifiers described above. Suitable boron-containing friction modifiers are described in U.S. Pat. No. 7,598,211, incorporated herein by reference and include the reaction product of diethanol amine and a fatty oil, that is subsequently reacted with boric acid to form a organo borate ester containing from about 0.5 to about 2.5 wt. % of boron, or as a further example, from about 0.8 to about 2 wt. % boron, or as an even further example, from about 1 to about 1.8 wt. % of boron. In one embodiment, the organo borate ester comprises a boric acid ester compound that provides from about 20 to about 200 ppm boron to a lubricant composition. In another embodiment, the organo borate ester comprises a boric acid ester compound that provides from about 40 to about 180 ppm boron to a lubricant composition. Accordingly, the lubricant composition may contain from about 0.5 to about 2.0 wt. %, such as from about 0.8 to about 1.8 wt. % of the boric acid ester compound based on a total weight of the lubricant composition.

(c) Antiwear Agents

Metal dihydrocarbyl dithiophosphate antiwear agents may be added to the lubricating oil composition as an ash-containing antiwear agent in accordance with an exemplary embodiment of the disclosure. Such antiwear agents typically comprise dihydrocarbyl dithiophosphate metal salts wherein the metal may be an alkali or alkaline earth metal, or aluminum, lead, tin, molybdenum, manganese, nickel, copper, titanium, or zinc. The zinc salts are most commonly used in lubricating oils.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting primary, secondary, or mixtures of primary and secondary alcohols with $P_2S_5$. To make the metal salt, any basic or neutral metal compound may be used but the oxides, hydroxides and carbonates are most generally used. Commercial additives frequently contain an excess of metal due to the use of an excess of the basic metal compound in the neutralization reaction.

The zinc dihydrocarbyl dithiophosphates (ZDDP) that are typically used are oil soluble salts of dihydrocarbyl dithiophosphoric acids and may be represented by the following formula:

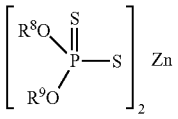

wherein $R^8$ and $R^9$ may be the same or different hydrocarbyl radicals containing from 1 to 18, typically 2 to 12, carbon atoms and including radicals such as alkyl, alkenyl, aryl, arylalkyl, alkaryl and cycloaliphatic radicals. Particularly desired as $R^8$ and $R^9$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R^8$ and $R^9$) in the dithiophosphoric acid will generally be about 5 or greater. The zinc dihydrocarbyl dithiophosphate may therefore comprise zinc dialkyl dithiophosphates. In one embodiment, the ZDDP compound is derived from all primary alcohols; all secondary alcohols; a mixture of primary and secondary alcohols; a mixture of a zinc dihydrocarbyl dithiophosphate derived from all primary alcohols and a zinc dihydrocarbyl dithiophosphate derived from all secondary alcohols; and mixtures thereof, wherein the mole percent of hydrocarbyl groups derived from primary alcohols in component (c) is at least 30 mole %. In another embodiment, at least 30 mole % or more of alcohols or hydrocarbyl groups are derived from primary alcohols and 70 mole % of alcohols or hydrocarbyl groups are derived from secondary alcohols, such as at least 60 mole % of alcohols or hydrocarbyl groups are derived from primary alcohols and 40 mole percent of alcohols or hydrocarbyl groups are derived from secondary alcohols. In yet another embodiment, the ZDDP compound is derived from all primary alcohols.

In order to limit the amount of phosphorus introduced into the lubricating oil composition by ZDDP to no more than 0.15 wt. % (1500 ppmw), the ZDDP should desirably be added to the lubricating oil compositions in amounts no greater than from about 1.1 to 1.3 wt. %, based upon the total weight of the lubricating oil composition. For example, the phosphorus-based antiwear agent may be present in a lubricating composition in an amount sufficient to provide from about 200 to about 1100 ppm by weight phosphorus based on a total weight of the lubricant composition. As a further example, the phosphorus-based wear preventative may be present in a lubricating composition in an amount sufficient to provide from about 500 to about 800 ppm by weight phosphorus to a fully formulated lubricant composition.

(d) Dispersant Additive

In an aspect of the disclosed embodiments, the methods and composition include the use of a functionalized dispersant additive as the primary and/or only dispersant in the lubricant composition. The functionalized dispersant is a reaction product of (i) a hydrocarbyl-dicarboxylic acid or anhydride, (ii) a polyamine, (iii) a dicarboxyl-containing fused-ring aromatic compound or anhydride thereof, and optionally, (iv) a non-aromatic dicarboxylic acid or anhydride. A suitable functionalized dispersant is described in U.S. Publication No. 2013/0040866, incorporated herein by reference.

Component (i)

The hydrocarbyl moiety of the hydrocarbyl-dicarboxylic acid or anhydride of Component (i) may be derived from butene polymers, for example polymers of isobutylene. Suitable polyisobutenes for use herein include those formed from polyisobutylene or highly reactive polyisobutylene having at least about 50 mole %, such as about 60 mole %, and particularly from about 70 mole % to about 90 mole % and above, terminal vinylidene content. Suitable polyisobutenes may include those prepared using $BF_3$ catalysts. The average number molecular weight of the polyalkenyl substituent may vary over a wide range, for example from about 100 to about 5000, such as from about 500 to about 5000, as determined by GPC using polystyrene as a calibration reference as described above.

The dicarboxylic acid or anhydride of Component (i) may be selected from maleic anhydride or from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters. A suitable dicarboxylic anhydride is maleic anhydride. A mole ratio of maleic anhydride to hydrocarbyl moiety in a reaction mixture used to make Component (i) may vary widely. Accordingly, the mole ratio may vary from about 5:1 to about 1:5, for example from about 3:1 to about 1:3, and as a further example, the maleic anhydride may be used in excess to force the reaction to completion. The unreacted maleic anhydride may be removed by vacuum distillation.

Component (ii)

Any of numerous polyamines can be used as Component (ii) in preparing the functionalized dispersant. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA), and heavy polyamines (also known as polyamine bottoms). Heavy polyamines may comprise a mixture of polyalkylenepolyamines having a mixture of higher and lower polyamine oligomers. Further, a polyamine blend could include heavy polyamines and lower polyamine oligomers. An example of such a mixture is POLYAMINE B20 available from AkzoNobel. The oligomers of polyamine bottoms may have seven or more nitrogen atoms, two or more primary amines per molecule, more cyclic amine structures (e.g., piperazine), and more extensive branching than conventional (lower polyamine) polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. In an embodiment of the disclosure, the polyamine may be selected from tetraethylene pentamine (TEPA).

In an embodiment, the functionalized dispersant may be derived from compounds of formula (I):

(I)

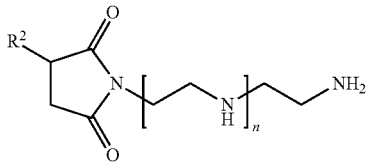

wherein n represents 0 or an integer of from 1 to 5, and $R^2$ is a hydrocarbyl substituent as defined above. In an embodiment, n is 3 and $R^2$ is a polyisobutenyl substituent, such as that derived from polyisobutylenes having at least about 50 mole %, such as about 60 mole %, such as about 70 mole % to about 90 mole % and above, terminal vinylidene content. Compounds of formula (I) may be the reaction product of a hydrocarbyl-substituted succinic anhydride, such as a polyisobutenyl succinic anhydride (PIBSA), and a polyamine, for example tetraethylene pentamine (TEPA). The foregoing compound of formula (1) may have a molar ratio of (1) polyisobutenyl-substituted succinic anhydride to (2) polyamine in the range of about 1:1 to about 10:1 in the compound, such as from about 1.2:1 to 5:1; and more desirably from about 1.5:1 to 3:1.

A particularly useful dispersant contains polyisobutenyl group of the polyisobutenyl-substituted succinic anhydride having a number average molecular weight (Mn) in the range of from about 500 to 5000 as determined by GPC using polystyrene as a calibration reference and a (2) polyamine having a general formula $H_2N(CH_2)_m$-[NH $(CH_2)_m]_n$—$NH_2$, wherein m is in the range from 2 to 4 and n is in the range of from 1 to 2.

Component (iii)

Component (iii) is a carboxyl or polycarboxyl acid or polyanhydride wherein the carboxyl acid or anhydride functionalities are directly fused to an aromatic group. Such carboxyl-containing aromatic compound may be selected from 1,8-naphthalic acid or anhydride and 1,2-naphthalenedicarboxylic acid or anhydride, 2,3-dicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,58-naphthalenetetracarboxylic acid or anhydride, perylene-3,4,9,10-tetracarboxylic anhydride, pyrene dicarboxylic acid or anhydride, and alike. The moles of Component (iii) reacted per mole of Component (ii) may range from about 0.1:1 to about 2:1. A typical molar ratio of Component (iii) to Component (ii) in the reaction mixture may range from about 0.2:1 to about 2.0:1. Another molar ratio of Component (iii) to Component (ii) that may be used may range from 0.25:1 to about 1.5:1. Component (iii) may be reacted with the other components at a temperature ranging from about 140° to about 180° C.

Component (iv)

Component (iv) is a non-aromatic carboxylic acid or anhydride having a number average molecular weight (Mn) of less than 500 Daltons. Suitable carboxylic acids or anhydrides thereof may include, but are not limited to acetic acid or anhydride, oxalic acid and anhydride, malonic acid and anhydride, succinic acid and anhydride, alkenyl succinic acid or anhydride, glutaric acid an anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid or anhydride, glycolic acid or anhydride, 1,2,3,6-tetrahydronaphthalic acid or anhydride, and the like. Component (iv) may be reacted on a molar ratio with Component (ii) ranging from about 0 to about 2.5 moles of Component (iv) per mole of Component (ii) reacted. The amount of Component (iv) used may be relative to the number of secondary amino groups in Component (ii). For example, from about 0.1 to about 2.5 moles of Component (iv) per secondary amino group in Component (ii) may be reacted with the other components to provide the dispersant according to embodiments of the disclosure. Another molar ratio of Component (iv) to Component (ii) that may be used may range from 0.25:1.5 to about 0.5:1 moles of Component (iv) per mole of Component (ii). Component (iv) may be reacted with the other components at a temperature ranging from about 140° to about 180° C.

A lubricant composition as described herein may contain from about 0.5 wt. % to about 10.0 wt. % of the functionalized dispersant additive described above based on a total weight of the lubricant composition. A typical range of functionalized dispersant additive may be from about 2 wt. % to about 7 wt. % based on a total weight of the lubricant composition.

(e) Additional Dispersant Additive Composition

In an aspect of the disclosed embodiments, the methods and composition may include the use of a dispersant additive composition that includes the foregoing functionalized dispersant additive and a conventional succinimide dispersant derived from a hydrocarbyl succinic acid or anhydride and an amine. Such conventional succinimide dispersants may be represented by the following formulas (I) and (II):

I

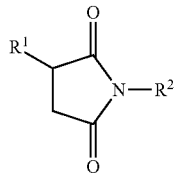

II

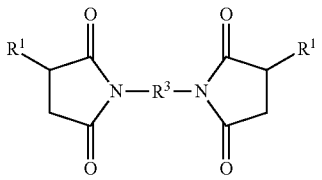

and mixtures thereof, wherein $R^1$ is a hydrocarbyl substituent is derived from a polyolefin having a number average molecular weight ranging from about 1000 to about 3000 Daltons as determined by gel permeation chromatography. A particularly suitable hydrocarbyl substituent is a compound derived from polypropene or polybutene having a number average molecular weight ranging from about 1200 to about 1400 Daltons. In one embodiment, $R^1$ is derived from a polybutene having greater than 50 mole percent terminal vinylidene groups. $R^2$ is selected from H, —$(CH_2)_mH$, and

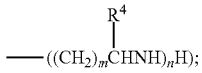

$R^3$ is

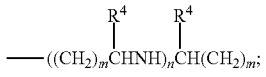

and $R^4$ is selected from hydrogen and —$(CH_3)$, wherein m is an integer ranging from 1 to 3, n is an integer ranging from 1 to 10. Methods for making conventional succinimide dispersants according to the above formulas are well known in the art and are described, for example U.S. Pat. Nos. 4,234,435 and 4,636,322. Such dispersants typically have a molar ratio of hydrocarbyl group ($R^1$) to dicarboxylic acid or anhydride moiety ranging from about 1:1 to about 3:1. Such dispersants may also be post-treated by conventional methods by a reaction with any of a variety of agents. Among such post-treating agents boron, urea, thiourea, dimercaptothidiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference.

A particularly suitable conventional succinimide dispersant includes a boronated dispersant having a nitrogen content ranging from about 1 wt. % to about 2.5 wt. %, such as from about 1.2 wt. % to about 2.0 wt. %, and desirably from about 1.4 wt. % to about 1.7 wt. % and a boron to nitrogen weight ratio ranging from about 0.1:1 to about 1:1, such as from about 0.2:1 to about 0.8:1 and particularly from about 0.4:1 to about 0.55:1.

The lubricant composition may contain a dispersant mixture having a weight ratio of (e) conventional dispersant to (d) functionalized dispersant ranging from about 1:1 to about 1:10, or from about 1:2 to about 1:9, or from about 1:3 to about 1:8, or from about 1:4 to about 1:7, or from about 1:5 to about 1:6. Accordingly, a lubricant composition as described herein may contain from about 0.5 wt. % to about 10.0 wt. % of a dispersant additive composition containing both the functionalized dispersant and the conventional dispersant based on a total weight of the lubricant composition. A typical range of dispersant additive composition may be from about 2 wt. % to about 6 wt. % based on a total weight of the lubricant composition. In addition to the foregoing dispersant additive composition, the lubricant composition may include other conventional ingredients, including but not limited to, friction modifiers, metal detergents, antiwear agents, antifoam agents, antioxidants, viscosity modifiers, pour point depressants, corrosion inhibitors and the like.

In one embodiment, the lubricant composition is devoid of additional dispersants. Accordingly, the only dispersant in the lubricant composition is component (d).

(f) Corrosion Inhibitor

In accordance with an embodiment of the disclosure, the lubricant composition described herein may contain an ashless corrosion inhibitor. Suitable ashless corrosion inhibitors include, but are not limited to 2,5-dimercapto-1,3,4-thiadiazoles and derivatives thereof. A particularly suitable corrosion inhibitor for use with the lubricant compositions described here is 2-hydrocarbyldithio-5-mercapto-1,3,4-thiadiazole of the formula

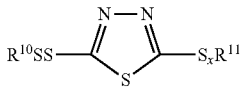

wherein $R^{10}$ is a $C_{6-26}$ alkyl group. A particularly suitable corrosion inhibitor is a compound of the foregoing formula wherein $R^{10}$ is an alkyl group containing from 8 to 18 carbon atoms. In the above formula X ranges from 0-8. When X is 0, $R^{11}$ is hydrogen. When X is greater than 0, $R^{11}$ may be $SR^{10}$. Compounds of the foregoing formula may be made according to the procedure described in U.S. Pat. No. 3,663,561.

In another embodiment, the corrosion inhibitor may be a mixture of:

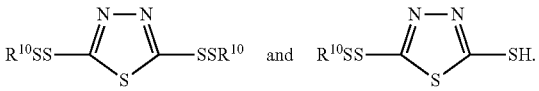

The amount of corrosion inhibitor used in the lubricant compositions described herein may range from about 0.01 to about 1 wt. % based on a total weight of the lubricant composition. In further examples, lubricant compositions described herein may contain 0.05 to about 0.5 wt. % of the foregoing corrosion inhibitor, from about 0.08 to about 0.25 wt. % of the corrosion inhibitor, or from about 0.1 to about 0.2 wt. % of the corrosion inhibitor based on a total weight of the lubricant composition.

(g) TBN Booster

In accordance with another embodiment of the disclosure, the lubricant compositions described herein may contain an ashless total base number (TBN) booster.

Suitable TBN boosters may include low molecular weight succinimides (such as having a molecular weight of from about 150 to about 450) and alkyl diphenylamine (or ADPA).

Further suitable TBN boosters are hindered amine light stabilizers (HALS) such as 2,26,6-tetramethylpiperidine and analogs and derivatives thereof, as described in US 20140024569A1, US 20130252865A1, U.S. Pat. No. 8,703,682, and EP2714867, incorporated herein by reference.

Sufficient amounts of TBN booster may be added to a lubricant composition to increase the TBN of the lubricant composition from about 1 to about 50 percent over a base TBN value of the lubricant composition. Other amounts of TBN booster may be added to a lubricant composition to increase the TBN from about 1 to about 30 percent, or from about 2 to about 25 percent or from about 3 to about 20 percent or from about 5 to about 10 percent over the base TBN value of the lubricant composition. The base TBN value of the lubricant composition is the TBN value of the lubricant composition before adding the reaction product described herein. A TBN booster may be added neat to the lubricant composition or may be diluted with diluents such as a process oil to increase the compatibility of the reaction product with a lubricant composition.

(h) Viscosity Index Improvers

The lubricating oil compositions herein also contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine. Suitable dispersant viscosity index improvers are disclosed, for example, in U.S. Pat. Nos. 4,863,623 and 5,075,383.

Each of the viscosity index improvers described herein may have number average molecular weight ($M_N$) ranging from about 10,000 to about 500,000 Daltons and a shear stability index (SSI) ASTM D3945 ranging from about 5 to about 35.

The total amount of viscosity index improver and/or dispersant viscosity index improver may be about 0 wt. % to about 20 wt. %, about 0.1 wt. % to about 15 wt. %, about 0.1 wt. % to about 12 wt. %, or about 0.5 wt. % to about 10 wt. %, of the lubricating composition.

Metal-Containing Detergents

The lubricant composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The detergent may be present at about 0 wt. % to about 10 wt. %, or about 0.1 wt. % to about 8 wt. %, or about 1 wt. % to about 4 wt. %, or greater than about 4 wt. % to about 8 wt. %.

Anti-Foam Agents

In some embodiments, a foam inhibitor may form another component suitable for use in the compositions. Foam inhibitors may be selected from silicones, polyacrylates, and the like. The amount of antifoam agent in the engine lubricant formulations described herein may range from about 0.001 wt. % to about 0.1 wt. % based on the total weight of the formulation. As a further example, antifoam agent may be present in an amount from about 0.004 wt. % to about 0.008 wt. %.

Oxidation Inhibitor Components

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as $\alpha$-olefins.

The one or more antioxidant(s) may be present in ranges about 0 wt. % to about 20 wt. %, or about 0.1 wt. % to about 10 wt. %, or about 1 wt. % to about 5 wt. %, of the lubricating composition.

Titanium-Containing Compounds

Another class of additives includes oil-soluble titanium compounds. The oil-soluble titanium compounds may function as antiwear agents, friction modifiers, antioxidants, deposit control additives, or more than one of these functions. In an embodiment the oil soluble titanium compound may be a titanium (IV) alkoxide. The titanium alkoxide may be formed from a monohydric alcohol, a polyol, or mixtures thereof. The monohydric alkoxides may have 2 to 16, or 3 to 10 carbon atoms. In an embodiment, the titanium alkoxide may be titanium (IV) isopropoxide. In an embodiment, the titanium alkoxide may be titanium (IV) 2-ethylhexoxide. In an embodiment, the titanium compound may be the alkoxide of a 1,2-diol or polyol. In an embodiment, the 1,2-diol comprises a fatty acid mono-ester of glycerol, such as oleic acid. In an embodiment, the oil soluble titanium compound may be a titanium carboxylate. In an embodiment the titanium (IV) carboxylate may be titanium neodecanoate.

In an embodiment the oil soluble titanium compound may be present in the lubricating composition in an amount to provide from zero to about 1500 ppm titanium by weight or about 10 ppm to 500 ppm titanium by weight or about 25 ppm to about 150 ppm.

Other Optional Additives

Other additives may be selected to perform one or more functions required of a lubricating fluid. Further, one or more of the mentioned additives may be multi-functional and provide functions in addition to or other than the function prescribed herein.

A lubricating composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, titanium-containing compounds, molybdenum containing compounds, seal swelling agents, and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt. % to about 1 wt. %, about 0.01 wt. % to about 0.5 wt. %, or about 0.02 wt. % to about 0.04 wt. % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt. % to about 5 wt. %, about 0.01 wt. % to about 3 wt. %, about 0.1 wt. % to about 2 wt. %, based upon the final weight of the lubricating oil composition.

In general terms, a suitable engine lubricant may include additive components in the ranges listed in the following Table 2:

TABLE 2

| Component | Wt. % (Broad) | Wt. % (Typical) |
|---|---|---|
| Dispersant (Reaction product of Components (i), (ii), (iii), and (iv) | 0.5-10.0 | 1.0-5.0 |
| Additional Dispersant(s) | 0-10% | 1.0-6.0% |
| Antioxidant(s) | 0-5.0 | 0.01-3.0 |
| Metal Detergent(s) | 0.1-15.0 | 0.2-8.0 |
| Ashless TBN booster(s) | 0.0-1.0 | 0.01-0.5 |
| Corrosion Inhibitor(s) | 0-5.0 | 0-2.0 |
| Metal dihydrocarbyl dithiophosphate(s) | 0.1-6.0 | 0.5-4.0 |
| Ash-free phosphorus compound(s) | 0-6.0 | 0.0-4.0 |
| Antifoaming agent(s) | 0-5.0 | 0.001-0.15 |
| Antiwear agent(s) | 0-1.0 | 0-0.8 |
| Pour point depressant(s) | 0.01-5.0 | 0.01-1.5 |
| Viscosity index improver(s) | 0.01-20.00 | 0.25-10.0 |
| Friction modifier(s) | 0-2.0 | 0.1-1.0 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

All patents and publications cited herein are fully incorporated by reference herein in their entirety.

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the disclosure.

Example 1

Functionalized Dispersant

The functionalized dispersant used in the following experiments is described more fully in U.S. Patent Publication No. 2013/0040866, which is incorporated herein by reference. The set-up requires a 1 L 4-neck flask with agitator, addition funnel, temperature probe, temperature controller, heating mantle, Dean-Stark trap, and a condenser. The flask was charged with 2100 $M_n$ polyisobutylene succinic anhydride (PIBSA) (195.0 g; 0.135 mole) and heated to 160° C. under a nitrogen blanket. Polyethylene amine mixture (21.17 g; 0.112 mole) was added drop-wise over 30 min. The reaction mixture was allowed to stir for 4 hours and then was vacuum stripped for 1 hour at 711 mm Hg. Process oil (172.0 g) was added and the mixture was stirred for 15 minutes. 1,8-Naphthalic anhydride (13.39 g; 0.068 mole) was added in one portion at 160° C. The reaction mixture was heated to 165° C. and allowed to stir for 4 hours. Vacuum was applied (711 mm Hg) for 1 hour to remove any residual water. The reaction product was pressure filtered over HIFLOW SUPER CEL CELITE to yield 364 g of a dark brown viscous liquid (% N, 1.75; TBN, 36.0).

A 500 mL flask was charged with the foregoing reaction product (200.0 g; 0.102 mole) and heated to 160° C. under a nitrogen blanket. Maleic anhydride (4.48 g: 0.045 mole) was added in one portion. The reaction mixture was allowed to stir for 4 hours and then was vacuum stripped for 1 hour at 711 mm Hg. Process oil (4.48 g) was added and the mixture was stirred for 15 min. The reaction product was pressure filtered over HIFLOW SUPER CEL CELITE to yield 165 g of a dark brown viscous liquid (% N, 1.67; TBN, 24.1).

Example 2

In the following examples, the lubricating compositions contained the additives described in the table with the balance being Group II base oil. The wear scars of lubricant compositions were determined using a High Frequency Reciprocating Rig (HFRR). In the HFRR wear test, a steel ball immersed in the oil was oscillated across a steel disk at a speed of 20 Hz over a 1 mm path. A 7 Newton (about 1.0 GPa) load was applied between the ball and the disk and the tests were performed while holding the oil at 120° C. for one hour. After testing, a two-dimensional profile of the wear scar on the disk was determined. The cross-sectional area of the wear scar was reported and listed in the following table wherein the lower the value of the cross-sectional area, the better the anti-wear performance of the oil.

In Table 3, FM1 was oleamide and FM2 was glycerol monooleate (GMO). The ZDDP 1 was zinc dihydrocarbyl dithiophosphate derived from a primary alcohol, 2-ethylhexanol. The Dispersant 1 was a compound made according to Example 1. The Dispersant 2 was a boronated hydrocarbyl succinimide dispersant which was not reacted with a dicarboxyl-containing fused aromatic compound or anhydride thereof. The results are shown in the following table.

TABLE 3

| | Comp. Ex. 1 | Comp. Ex. 2 | Inv. Ex. A | Inv. Ex. B | Inv. Ex. C | Inv. Ex. D | Inv. Ex. E |
|---|---|---|---|---|---|---|---|
| FM1 (wt %) | — | — | 0.04 | 0.04 | 0.2 | 0.2 | 0.2 |
| FM2 (wt %) | — | 0.4 | — | — | — | — | — |
| FM3 (wt %) | — | — | — | — | — | — | — |
| ZDDP 1 (ppmw P) | 1100 | 1100 | 1100 | 1100 | 1100 | 1100 | 1100 |
| Dispersant 1 (wt %) | 5 | 5 | 2 | 7 | 2 | 5 | 7 |
| Dispersant 2 (wt %) | 2 | 2 | 2 | 2 | 2 | 2 | 2 |
| Wear Scar ($\mu m^2$) | 906 | 356 | 138 | 338 | 303 | 169 | 180 |

As shown by the foregoing examples, a lubricant composition containing a combination of FM1, ZDDP 1, and the dispersant of Example 1 provided a significant reduction in wear scar than comparable compositions with other friction modifiers. The treat rate of FM1 required to achieve comparable or better wear scar results to the examples containing other friction modifiers was significantly less.

In Table 4, ZDDP 1 was zinc dihydrocarbyl dithiophosphate derived from all primary alcohols, namely 2-ethylhexanol. ZDDP 2 was zinc dihydrocarbyl dithiophosphate derived from a mixture of primary and secondary alcohols, wherein the ZDDP at least 60 mole % of the hydrocarbyl groups in the ZDDP were derived from primary alcohols. The ZDDP 3 was zinc dihydrocarbyl dithiophosphate derived from all secondary alcohols. The ZDDP 4 was a 50/50 mixture by ppm of phosphorus of ZDDP 2 and ZDDP 3. At least 30 mole % of the hydrocarbyl groups in the ZDDP 4 mixture were derived from primary alcohols. The dispersants were the dispersants described according to Example 1.

TABLE 4

| | Oleamide Wt. % | ZDDP 1 ppmw P | ZDDP 2 ppmw P | ZDDP 3 ppmw P | ZDDP 4 ppmw P | Dispersant 1 Wt. % | Dispersant 2 Wt. % | Wear Scar ($\mu m^2$) |
|---|---|---|---|---|---|---|---|---|
| Inv. Ex. A | 0.04 | 1100 | — | — | — | 2 | 2 | 138 |
| Inv. Ex. F | 0.04 | — | 1100 | — | — | 2 | 2 | 308 |
| Comp. Ex. 3 | 0.04 | — | — | 1100 | — | 2 | 2 | 782 |
| Inv. Ex. C | 0.2 | 1100 | — | — | — | 2 | 2 | 303 |
| Inv. Ex. G | 0.2 | — | 1100 | — | — | 2 | 2 | 384 |
| Comp. Ex. 4 | 0.2 | — | — | 1100 | — | 2 | 2 | 513 |
| Inv. Ex. D | 0.2 | 1100 | — | — | — | 5 | 2 | 169 |
| Inv. Ex. H | 0.2 | — | 1100 | — | — | 5 | 2 | 437 |
| Inv. Ex. I | 0.2 | — | — | — | 1100 | 5 | 2 | 457 |
| Comp. Ex. 5 | 0.2 | — | — | 1100 | | 5 | 2 | 516 |
| Inv. Ex. J | 0.04 | — | — | — | 1100 | 5 | 2 | 526 |
| Inv. Ex. B | 0.04 | 1100 | — | — | — | 7 | 2 | 338 |
| Inv. Ex. K | 0.04 | — | 1100 | — | — | 7 | 2 | 444 |
| Comp. Ex. 6 | 0.04 | — | — | 1100 | — | 7 | 2 | 836 |
| Inv. Ex. E | 0.2 | 1100 | — | — | — | 7 | 2 | 180 |

TABLE 4-continued

| | Oleamide Wt. % | ZDDP 1 ppmw P | ZDDP 2 ppmw P | ZDDP 3 ppmw P | ZDDP 4 ppmw P | Dispersant 1 Wt. % | Dispersant 2 Wt. % | Wear Scar ($\mu m^2$) |
|---|---|---|---|---|---|---|---|---|
| Inv. Ex. L | 0.2 | — | 1100 | — | — | 7 | 2 | 449 |
| Comp. Ex. 7 | 0.2 | — | — | 1100 | — | 7 | 2 | 783 |

As shown by the foregoing examples, compositions containing ZDDP 4 derived from 30 mole percent or more of primary alcohols, in combination with oleamide provided a significant reduction in wear scar compared to the sample compositions containing less than 30 mole percent of ZDDP 3 derived from primary alcohols. The lubricant compositions containing ZDDP 2 derived from at least 60 mole percent or more of primary alcohols, in combination with oleamide provide further improved reduction in wear scar. The lubricant compositions containing ZDDP 1 derived from all primary alcohols, in combination with oleamide provided even further improved reduction in wear scar.

At numerous places throughout this specification, reference has been made to a number of U.S. patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricant for a compression-ignited engine, the lubricant comprising:

(a) a base oil;

(b) about 0.04 wt. % to about 0.2 wt. % oleamide, based on a total weight of the lubricant;

(c) zinc dihydrocarbyl dithiophosphate in an amount sufficient to provide about 500 to about 1500 ppm by weight phosphorus to the lubricant, based on the total weight of the lubricant, and wherein the zinc dihydrocarbyl dithiophosphate is derived from all primary alcohols or a mixture of primary and secondary alcohols, wherein at least 30 mole % of the mixture of primary and secondary alcohols are primary alcohols; and (d) about 2 wt. % to about 7 wt. % of a functionalized dispersant, based on the total weight of the lubricant, said functionalized dispersant comprising a reaction product of (i) a hydrocarbyl-dicarboxylic acid or anhydride, (ii) a polyamine, (iii) a carboxyl or polycarboxyl acid or polyanhydride wherein the carboxyl acid or anhydride functionalities are directly fused to an aromatic group, and (iv) a non-aromatic dicarboxylic acid or anhydride, wherein the hydrocarbyl group of the hydrocarbyl-dicarboxylic acid or anhydride has a number average molecular weight of greater than 1800 Daltons as determined by gel permeation chromatography.

2. The lubricant of claim 1, wherein component (iii) comprises 1,8-naphthalic anhydride.

3. The lubricant of claim 1, wherein component (i) comprises a polyisobutenyl succinic acid or anhydride, component (iii) comprises 1,8-naphthalic anhydride, and component (iv) comprises maleic anhydride.

4. The lubricant of claim 3, wherein the polyisobutenyl group of component (d) is derived from polyisobutylene having greater than 50 mole percent terminal vinylidene content.

5. The lubricant of claim 1, wherein from about 0.25 to about 1.5 moles of component (iv) are reacted per mole of component (ii).

6. The lubricant of claim 1, wherein the lubricant further comprises (e) one or more hydrocarbyl substituted succinimide dispersants other than component (d), wherein the hydrocarbyl substituent of component (e) is derived from a polyolefin having a number average molecular weight ranging from about 950 to about 3000 Daltons as determined by gel permeation chromatography and wherein a weight ratio of (e) to (d) in the lubricant ranges from about 1:1 to about 1:10.

7. The lubricant of claim 1, wherein the zinc dihydrocarbyl dithiophosphate of component (c) is derived from all primary alcohols.

8. The lubricant of claim 1, wherein the zinc dihydrocarbyl dithiophosphate of component (c) is derived from the mixture of primary and secondary alcohols and wherein at least 60 mole % of hydrocarbyl groups in the zinc dihydrocarbyl dithiophosphate are derived from primary alcohols.

9. The lubricant of claim 1, wherein component (iii) comprises 1,8-naphthalic acid or anhydride; 1,2-naphthalenedicarboxylic acid or anhydride; 2,3-dicarboxylic acid or anhydride; naphthalene-1,4-dicarboxylic acid; naphthalene-2,6-dicarboxylic acid; phthalic anhydride; pyromellitic anhydride; 1,2,4-benzene tricarboxylic acid anhydride; diphenic acid or anhydride; 2,3-pyridine dicarboxylic acid or anhydride; 3,4-pyridine dicarboxylic acid or anhydride; 1,4,5,8-naphthalenetetracarboxylic acid or anhydride; perylene-3,4,9,10-tetracarboxylic anhydride; or pyrene dicarboxylic acid or anhydride.

10. The lubricant of claim 1 wherein the component (iv) comprises acetic acid or anhydride; oxalic acid or anhydride; malonic acid or anhydride;

succinic acid or anhydride; alkenyl succinic acid or anhydride; glutaric acid or anhydride;

adipic acid or anhydride; pimelic acid or anhydride; suberic acid or anhydride; azelaic acid or anhydride; sebacic acid or anhydride; maleic acid or anhydride; fumaric acid or anhydride; tartaric acid or anhydride; glycolic acid or anhydride; or 1,2,3,6-tetrahydronaphthalic acid or anhydride.

11. The lubricant of claim 8, wherein the zinc dithiophosphate of component (c) delivers approximately 1100 ppm of phosphorus to the lubricant based on a total weight of the lubricant.

12. A method for reducing wear in a compression-ignited engine, the method comprising:

(1) lubricating the engine with a lubricant comprising:

(a) a base oil;

(b) about 0.04 wt. % to about 0.2 wt. % oleamide, based on a total weight of the lubricant;

(c) zinc dihydrocarbyl dithiophosphate in an amount sufficient to provide about 500 to about 1500 ppm by weight phosphorus to the lubricant, based on the total weight of the lubricant, and wherein the zinc dihydrocarbyl dithiophosphate is derived from all primary alcohols or a mixture of primary and secondary alcohols, wherein at least 30 mole % of the mixture of primary and secondary alcohols are primary alcohols; and (d) about 2 wt. % to about 7 wt. % of a functionalized dispersant, based on the total weight of the lubricant, said functionalized dispersant comprising a reaction product of (i) a hydrocarbyl-dicarboxylic acid or anhydride, (ii) a polyamine, (iii) a carboxyl or polycarboxyl acid or polyanhydride wherein the carboxyl acid or anhydride functionalities are directly fused to an aromatic group, and (iv) a non-aromatic dicarboxylic acid or anhydride, wherein the hydrocarbyl group of the hydrocarbyl-dicarboxylic acid or anhydride has a number average molecular weight of greater than 1800 Daltons as determined by gel permeation chromatography.

13. The method of any of claims 12, wherein component (i) comprises a polyisobutenyl succinic acid or anhydride, component (iii) comprises 1,8-naphthalic anhydride, and component (iv) comprises maleic anhydride.

14. The method of claim 12, wherein the polyisobutenyl group of component (d) is derived from polyisobutylene having greater than 50 mole percent terminal vinylidene content.

15. The method of claim 12, wherein component (iii) comprises 1,8-naphthalic acid or anhydride; 1,2-naphthalenedicarboxylic acid or anhydride; 2,3-dicarboxylic acid or anhydride; naphthalene-1,4-dicarboxylic acid; naphthalene-2,6-dicarboxylic acid; phthalic anhydride; pyromellitic anhydride; 1,2,4-benzene tricarboxylic acid anhydride; diphenic acid or anhydride; 2,3-pyridine dicarboxylic acid or anhydride; 3,4-pyridine dicarboxylic acid or anhydride; 1,4,5,8-naphthalenetetracarboxylic acid or anhydride; perylene-3,4,9,10-tetracarboxylic anhydride; or pyrene dicarboxylic acid or anhydride.

16. The method of claim 12, wherein component (iv) comprises acetic acid or anhydride; oxalic acid or anhydride; malonic acid or anhydride; succinic acid or anhydride; alkenyl succinic acid or anhydride; glutaric acid or anhydride; adipic acid or anhydride; pimelic acid or anhydride; suberic acid or anhydride; azelaic acid or anhydride; sebacic acid or anhydride; maleic acid or anhydride; fumaric acid or anhydride; tartaric acid or anhydride; glycolic acid or anhydride; or 1,2,3,6-tetrahydronaphthalic acid or anhydride.

17. The method of claim 12, wherein the zinc dihydrocarbyl dithiophosphate of component (c) is derived from all primary alcohols.

18. The method of claim 12, wherein the zinc dihydrocarbyl dithiophosphate of component (c) is derived from the mixture of primary and secondary alcohols and wherein at least 60 mole % of hydrocarbyl groups in the zinc dihydrocarbyl dithiophosphate are derived from primary alcohols.

19. The method of claim 12, wherein the zinc dithiophosphate of component (c) delivers approximately 1100 ppm of phosphorus to the lubricant based on a total weight of the lubricant.

* * * * *